United States Patent [19]

Oba et al.

[11] Patent Number: 4,690,484

[45] Date of Patent: Sep. 1, 1987

[54] WAFER AND METHOD FOR MANUFACTURING SWITCH WAFER

[75] Inventors: Hiroki Oba, Furukawa; Seiichi Aoki, Miyagi; Akira Niinuma, Furukawa; Seiichiro Sato, Tajiri, all of Japan

[73] Assignee: Alps Electric Co., Ltd., Japan

[21] Appl. No.: 813,649

[22] Filed: Dec. 26, 1985

[30] Foreign Application Priority Data

Dec. 25, 1984 [JP] Japan ..... 59-275084

[51] Int. Cl.[4] ..... H01R 13/516

[52] U.S. Cl. ..... 439/736; 439/861

[58] Field of Search ..... 339/191-193, 339/218, 258 R, 258 P

[56] References Cited

U.S. PATENT DOCUMENTS

| | | | |
|---|---|---|---|
| 1,833,984 | 12/1931 | Bohlman | 339/193 S |
| 1,880,511 | 10/1932 | Soreny | 339/193 S |
| 4,030,799 | 6/1977 | Venaleck | 339/218 M |

FOREIGN PATENT DOCUMENTS

| | | | |
|---|---|---|---|
| 3345435 | 6/1984 | Fed. Rep. of Germany | 339/218 M |

*Primary Examiner*—Joseph H. McGlynn

*Attorney, Agent, or Firm*—Guy W. Shoup

[57] ABSTRACT

A method for manufacturing a switch includes the steps of forming integrally a clip for clamping a movable contact out of a flat terminal member configured in hoop material by bending uprightly a projected portion of the terminal member, and then insert-molding the thus bent terminal member at the bottom of a box body made of insulating material to hold the integrally formed clip inside the box body.

3 Claims, 3 Drawing Figures

WAFER AND METHOD FOR MANUFACTURING SWITCH WAFER

BACKGROUND OF THE INVENTION

1. Field of the Invention

This invention relates to a switch casing and, more particularly, to a switch wafer used as a structural element in manufacturing a push button switch which is small in size and needs little torque for operation.

2. Description of the Prior Art

Conventional switches of the above type had the structure in which a lead terminal is simply fixed on an inner wall face or bottom of the switch casing. Thereafter, in order to complete the switch additional parts had to be assembled in a space inside the casing, such as a movable segment having a movable contact means for connecting the movable segment to the lead terminal a slide for actuating the movable segment, and a returning spring.

Accordingly, the conventional switch needed a number of parts, was difficult to miniaturize, and required a complicated assembling work, thereby resulted in an increased manufacturing cost.

SUMMARY OF THE INVENTION

It is the object of the present invention to solve the foregoing problems of the prior art and to provide a wafer and a method for manufacturing a switch wafer by which a novel switch can be manufactured that is miniaturized, simplified in assembling work, reduced in number of parts, lowered in manufacturing cost and strengthened structurally.

In order to achieve the foregoing object, the present invention provides a method for manufacturing a switch wafer comprising the steps of forming integrally a clip for clamping thereto a movable contact segment from a terminal member defined in a strip of hoop material by bending uprightly a portion of the bent terminal member, and then insert-molding the terminal member at the bottom of a box body made of insulating material to envelop the clip inside the box body.

In another version the present invention provides a switch comprising a switch case with the upper side opened, a terminal member insert-held at the bottom of the switch case, and a clip for clamping a movable contact thereto being integral with the terminal and formed by bending uprightly a portion of the terminal member.

DETAILED DESCRIPTION OF THE PREFERRED EMBODIMENTS

Figure 1:
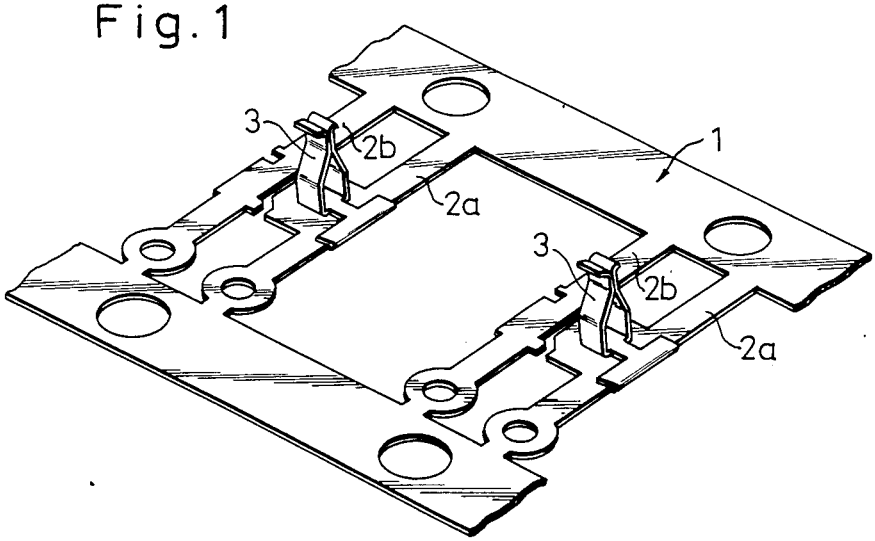
FIG. 1 is a perspective view of hoop material forming a part of the present invention.
Figure 2:
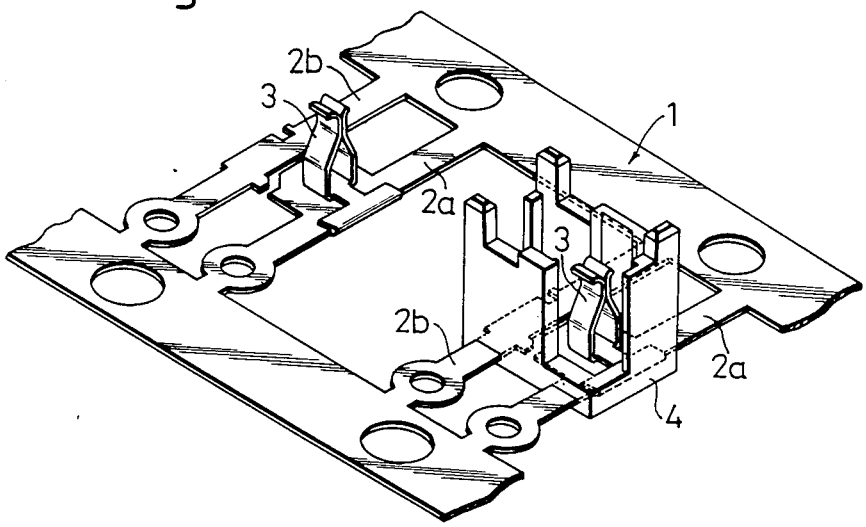
FIG. 2 is a perspective view showing a manufacturing process according to the present invention.
Figure 3:
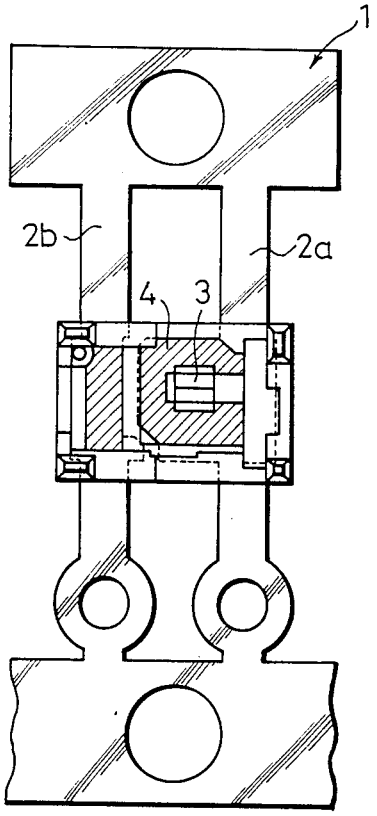
FIG. 3 is a lateral sectional view of the parts shown in FIG. 2.

Embodiments of the present invention will now be described with reference to the drawings.

In the drawings, reference numeral 1 indicates a segment of hoop material, in which paired terminal members *2a, 2b* are configured consecutively.

One terminal member *2a* is formed integrally with a clip 3 which is formed from a T shaped projected portion thereof folded over 180 degrees and further bent at its end 90 degrees to form upright segments.

A box body 4 with the upper side opened made of insulating material, such as synthetic resin, is formed by lateral insert molding with the terminal members *2a, 2b* having the clip 3 integral therewith, and the terminal members *2a, 2b* are then cut off from the hoop material 1.

The switch wafer according to the present invention is manufactured through the foregoing processes; as a result, the terminal members *2a, 2b* and the clip 3 which is integral with and electrically coupled to the former are enveloped by the molding, the clip 3 is used such as to clamp a movable contact segment of the switch.

Through the upper opening of the thus manufactured switch wafer additional parts are accommodated, such as a movable terminal having a movable contact clampingly engageable with the clip 3, a slide for actuating the movable terminal, and a returning spring for returning the slide, or a coil spring functioning as both the foregoing returning spring and movable terminal. A case is then put on the upper opening of the thus assembled switch wafer to cover the same, whereby the switch is completed.

As is apparent from the foregoing description, according to the present invention, the clip for clamping the movable contact is integral with the terminal member and both are enveloped in the switch wafer; thus, the assembling process of the wafer itself and of the switch by the use of the wafer is remarkably simplified because of a reduction in number of parts, and the manufacturing cost can be lowered. Further, the present switch can be structurally strengthened because the terminal members are insert-molded in the box body and can possess a lengthened lifetime.

What is claimed is:

1. A method of manufacturing a switch body, having a clip contact held therein which is connected to a terminal member, comprising the steps of:

forming from an integral piece of plate material a hoop segment connected to a terminal member connected to a T-shaped clip portion;

bending the T-shaped clip portion back 180 degrees over the terminal member and then bending the T-ends of the clip portion uprightly substantially 90 degrees toward each other so as to form a clip contact extending upright with respect to said terminal member; then insert-molding a box body made of insulating material such that the terminal member is molded at the bottom of the box body with the clip contact held upright in an enclosure defined in the box body.

2. A method as claimed in claim 1, further including the step of cutting off the insert-molded switch body from the piece of plate material by cutting the terminal member from the hoop segment.

3. A switch body formed by the method as claimed in claim 1.

* * * * *